United States Patent [19]

Ohta et al.

[11] Patent Number: 4,887,957

[45] Date of Patent: Dec. 19, 1989

[54] NOZZLE FOR MELT SPINNING OF PITCH AND METHOD FOR SPINNING PITCH

[75] Inventors: Masakatsu Ohta; Masaaki Itoi, both of Kimitsu, Japan

[73] Assignee: Idemitsu Kosan Co., Ltd., Tokyo, Japan

[21] Appl. No.: 253,762

[22] Filed: Oct. 5, 1988

[30] Foreign Application Priority Data

Oct. 9, 1986 [JP] Japan ..... 61-240740
Feb. 25, 1987 [JP] Japan ..... 62-042146

[51] Int. Cl.[4] ..... D01D 4/02

[52] U.S. Cl. ..... 425/72.2; 425/382.2; 425/463

[58] Field of Search ..... 264/29.2, 177.1, 177.15, 264/177.16, 176.1; 423/447.2; 425/725, 382.2, 463

[56] References Cited

U.S. PATENT DOCUMENTS

| | | | |
|---|---|---|---|
| 4,480,977 | 11/1984 | Nazem | 425/192 S |
| 4,504,454 | 3/1985 | Riggs | 423/447.1 |
| 4,511,625 | 4/1985 | Nazem et al. | 428/401 |
| 4,576,811 | 3/1986 | Riggs et al. | 423/447.2 |
| 4,590,055 | 5/1986 | Yamada et al. | 423/447.4 |
| 4,620,919 | 11/1986 | Uemura et al. | 208/45 |
| 4,717,331 | 1/1988 | Maeda et al. | 425/467 |

FOREIGN PATENT DOCUMENTS

| | | | |
|---|---|---|---|
| 0166388 | 1/1986 | European Pat. Off. | 264/29.2 |
| 0232051 | 8/1987 | European Pat. Off. | 264/29.2 |
| 2542330 | 9/1984 | France . | |
| 2554835 | 5/1985 | France . | |
| 59-88909 | 5/1984 | Japan . | |
| 59-163422 | 9/1984 | Japan . | |
| 59-168127 | 9/1984 | Japan . | |
| 60-194120 | 10/1985 | Japan | 264/29.2 |
| 60-259609 | 12/1985 | Japan . | |
| 61-112919 | 1/1986 | Japan . | |
| 61-163704 | 4/1986 | Japan | 425/461 |
| 61-186520 | 8/1986 | Japan . | |

*Primary Examiner*—Jay H. Woo
*Assistant Examiner*—K. P. Nguyen
*Attorney, Agent, or Firm*—Frishauf, Holtz, Goodman & Woodward

[57] ABSTRACT

A nozzle for melt spinning of pitch to produce pitch fibers which are to be used in production of carbon fibers, includes a pitch flow section and a plurality of nozzle holes provided in the bottom of the nozzle. The pitch is passed through a pitch flow turning section, a pitch reservoir section, and the plurality of nozzle holes. Pitch can be spun without causing cracks and unevenness in spinning to produce pitch fibers which can provide excellent carbon fibers on calcination.

15 Claims, 4 Drawing Sheets

NOZZLE FOR MELT SPINNING OF PITCH AND METHOD FOR SPINNING PITCH

This is a division of application Ser. No. 07/096,858 filed Sep. 14, 1987, now U.S. Pat. No. 4,816,202.

BACKGROUND OF THE INVENTION

The present invention relates to a nozzle for melt spinning of pitch and more particularly to a pitch melt spinning nozzle for production of pitch fibers which are to be used in production of carbon fibers.

Carbon fibers have been increasingly used in various applications because they are light and have high electrical conductivity and heat resistance. In particular, carbon fibers made from pitch fibers are widely used because over those fibers made from other carbonaceous materials, the yield at the carbonization step is high, and the modulus of elasticity of fibers is high.

If, however, cracks are formed in pitch fibers, carbon fibers obtained by calcination of the pitch fibers will suffer from development of cracks therein, thereby resulting in a reduction of mechanical strength thereof. Thus, in order to inhibit the development of cracks in pitch fibers to increase the mechanical strength of the final carbon fibers, various spinning methods for production of pitch fibers have been proposed.

For example, Japanese Patent Application Laid-Open Nos. 88909/1984 and 12919/1986 disclose a pitch spinning method in which pitch is passed through a filler layer provided above a spinning nozzle and, thereafter, it is passed through the spinning nozzle. Experiments, however, have revealed that in accordance with the above method, the development of cracks can be prevented to a certain extent, but not sufficiently and furthermore, if spinning is continued for a long period of time, spinning unevenness is produced.

In melt spinning of pitch containing optically anisotropic components, pitch molecules are orientated in a fiber axis direction. It has been found that even if the same pitch is used, the orientation in cross section of a carbon layer varies with spinning conditions and according to microscopic observation of the cross section vertical to the fiber axis, it can be divided into three types: radial type in which the cross sectional orientation is in a radial form, onion type in which it is in a concentric form, and random type in which there is no regular orientation.

In the case of pitch fibers having the radial type cross section, when they are subjected to carbonization or graphitization treatment after the spinning step, cracks will develop in the surface thereof in a direction of the fiber axis and seriously decrease the strength of the final carbon fibers.

It is therefore generally said that pitch fibers having the random or onion type cross section are preferred for production of carbon fibers. For this reason, an endeavor has been made to find spinning conditions which produce pitch fibers having a cross section of either the random type or the onion type.

For example, pitch fibers having the onion type cross section can be relatively easily produced only when a single fiber is spun, but they are very difficult to produce when a number of fibers are spun by the use of one nozzle unit on a commercial scale. Thus, in order to prevent cracks in pitch fibers at the step of spinning on a commercial scale, various melt spinning methods to produce the onion type cross section have been proposed.

For example, a method in which various fillers are charged in an upstream space to a hole or opening of a nozzle (hereinafter referred to as a "nozzle hole") (see, for example, Japanese Patent Application Laid-Open Nos. 88909/1984, 259609/1985 and 186520/1986) and a method using a nozzle the inside surface of which is shaped in a complicated form (see, for example, Japanese Patent Application Laid-Open Nos. 163422/1984, 168127/1984 and 252723/1985) are known.

The former method, however, has disadvantages in that since the filler is not packed uniformly to all of the nozzle holes, there cannot be obtained pitch fibers having a uniform diameter and, moreover, since the space in which the filler is packed is usually very small and there are a number of nozzle holes, charging of the filler and cleaning of the space are too complicated.

The latter method also has disadvantages in that the nozzle is difficult to produce because there are a number of nozzle holes and the diameter of the nozzle hole is too small, and cleaning of the nozzle is too difficult.

SUMMARY OF THE INVENTION

An object of the present invention is to provide a nozzle for melt spinning of pitch, i.e., pitch melt spinning nozzle for production of pitch fibers, which prevents cracks which may develop at the step of spinning, thereby permitting production of carbon fibers which are free from cracks, and which has such a simple form as to be able to produce with ease and clean the inside thereof.

Other objects and features of the present invention will become apparent from the following detailed explanation.

As a result of careful examination of conventional melt spinning techniques, it was thought that disturbing the flow of pitch prior to discharge from the nozzle hole and an abrupt reduction in pitch inner pressure between the upstream portion and the downstream portion of the nozzle through which the pitch passes are effective in improving the orientation in the fiber axis direction. It has thus been discovered that if there is used a nozzle which is effective in causing the disturbance of the pitch flow in the upstream portion and the abrupt change in the pitch inner pressure and further which is of simple structure, cracks can be prevented even though the onion type cross section is not always obtained, and carbon fibers having satisfactory strength and modulus of elasticity can be obtained. Based on this discovery, the present invention has been completed.

Thus the present invention relates to a nozzle for melt spinning of pitch to produce pitch fibers, which is characterized in that the nozzle includes a pitch flow section, two or more nozzle holes per the pitch flow section are provided in the bottom of the nozzle, and the length of the nozzle hole is 0.05 to 5 mm. This invention is hereinafter referred to as "first invention".

It has also been found that the above object is attained by passing pitch through a nozzle in which in the upstream portion to a nozzle hole having a nozzle hole index F of at least 10, a pitch flow turning section and a pitch reservoir section in which an angle between the top surface and the spinning direction is from 45° to 100°, preferably from 45° to 90°.

Thus in the present invention the pitch is passed through a nozzle including a pitch flow turning section, a pitch reservoir section in which the angle $\alpha$ between the top surface and the spinning direction is from 45° to 100°, preferably from 45° to 90°, and a nozzle hole having a nozzle hole index F ($=Z^2/d \cdot l$) of at least 10, first through the flow turning section, secondly through the pitch reservoir section, and finally through the nozzle hole. This invention is hereinafter referred to as "second invention".

DETAILED DESCRIPTION OF THE INVENTION

Figure 1A:
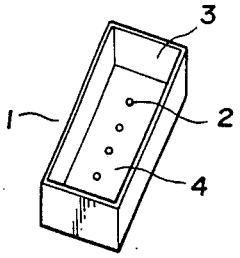
FIG. 1 is a perspective view of an embodiment of the nozzle of the first invention.

First the first invention will hereinafter be explained.

In the pitch melt spinning nozzle of the first invention, the length of the nozzle hole is usually 0.05 to 5 mm and preferably 0.1 to 2 mm. The diameter of the nozzle hole is usually 0.1 to 0.5 mm. The ratio of nozzle hole length (l) to nozzle hole diameter (d), i.e., l/d is 0.5/1 to 10/1.

The length of the nozzle hole is desirable to be as large as possible within the range that the necessary strength can be obtained because a longer nozzle hole produces a more abrupt reduction in the pitch inner pressure.

If the length of the nozzle hole is in excess of 5 mm, the above abrupt reduction in inner pressure does not occur and the pitch is in a laminar flow, thereby producing cracks. On the other hand, if it is less than 0.05 mm, the nozzle plate is of low strength.

In the pitch melt spinning nozzle of the first invention, two or more nozzle holes per one of the pitch flow section should be provided. The number of nozzle holes per the pitch flow section varies with the size of the pitch flow section; it is desirable that one nozzle hole per an area of 0.1 to 50 $mm^2$ be provided.

If two or more nozzle holes are provided in the bottom of the pitch flow section in such a manner that they are relatively adjacent to each other, the molten pitch flows flowing into each nozzle are disturbed by each other and a turbulent flow tends to be produced.

This is called a "disturbing effect" in the present invention. This disturbing effect is not limited to the turbulent flow in the flow dynamics but means its tendency.

The disturbing effect is influenced by an angle at which the pitch flows into the nozzle hole, i.e., an angle between the inner surface of the nozzle in the neighborhood of the nozzle hole and the central line in the axial direction of the nozzle hole. This angle is called a "pitch flowing angle $\alpha$". In the first invention, the pitch flowing angle is preferably 45° to 100°, more preferably 45° to 90°. If the pitch flowing angle $\alpha$ is less than 45°, a laminar flow tends to be formed. On the other hand, if it is in excess of 100°, the pitch stays in the neighborhood of the nozzle hole and cleaning, for example, in the inside of the nozzle becomes difficult.

The pitch flowing angle $\alpha$ considerably varies with the direction of the above cross section depending on the shape of the bottom of the pitch flow section. In the present invention, the maximum of the pitch flowing angle when the direction of the cross section is turned is referred to as the "maximum pitch flowing angle $\alpha$ max", and the minimum of the pitch flowing angle, as the "minimum pitch flowing angle $\alpha$ min".

The shape of the pitch flow section is preferably designed so that the length in the pitch flow direction is small, because the laminar flow is less produced. Moreover it is preferred that the walls of the pitch flow section be near the inlet of the nozzle hole, because the laminar flow is disturbed, with good results.

The distance between the neighborhood of the inlet of the nozzle hole and the inner wall of the pitch flow section can be expressed by the average shortest wall distance as defined below.

Figure 9:
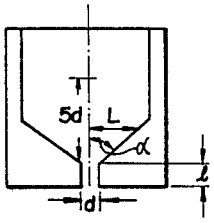
FIG. 9 is a vertical sectional view illustrating the form of the pitch flow section.

Assuming that as illustrated in FIG. 9, the diameter of the nozzle hole is d and the distance from the central line extending upward from the inlet of the nozzle to the nearest inner wall in the vertical direction relative to the central line is L, the average of L up to the height of $5d$ is defined as Lav, which is referred to as the "average shortest wall distance".

In the pitch flow section of the nozzle of the first invention, it is preferred that the average shortest wall distance be 1 to 25 times d ($1d$ to $25d$).

The depth of the pitch flow section in the nozzle of the first invention is preferably in the range of $5d$ to $200d$. If the depth of the pitch flow section is less than $5d$, the strength of the nozzle bottom plate is low, while if it is in excess of $200d$, the pitch is in the laminar flow.

Figure 2A:
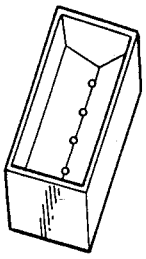
FIG. 2 is a perspective view and a cross sectional view of another embodiment of the nozzle of the first invention.
Figure 2B:
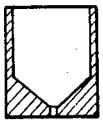
Figure 3:
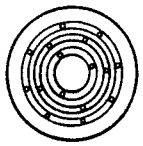
FIGS. 3 and 4 are each a top plan view of another embodiment of the nozzle of the first invention.
Figure 4:
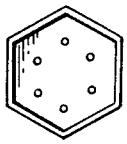
Figure 5:
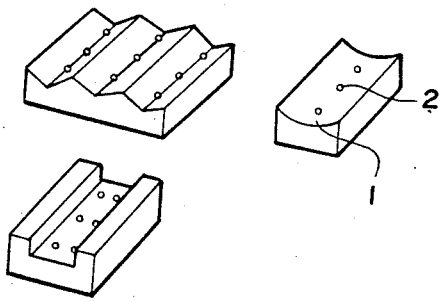
FIG. 5 is a perspective view of a nozzle bottom of another embodiment of the nozzle of the first invention, which has no side walls.

The pitch flow section of the nozzle of the first invention can be designed in various forms. In an embodiment illustrated in FIG. 1, four nozzle holes 2–2 are provided in a vertical direction in the center of the bottom of the pitch flow section 1 shaped in the form of rectangular parallelopiped. FIG. 2 illustrates another embodiment in which fours nozzle holes are provided in the bottom lines of a wedge-formed pitch flow section. FIG. 3 illustrates another embodiment in which the shape of FIG. 2 is elongated and a number of nozzle holes are provided in an arc arrangement or a circular arrangement. FIG. 4 illustrates another embodiment in which the pitch flow section is in a hexagonal form or a regular polygonal form. FIG. 5 illustrates another embodiment in which there are no vertical side walls and nozzle holes are provided in the central line of a groove having a wave-shaped or circle-shaped cross section. The pitch flow sections designed in the above shapes are preferably used in the present invention.

Figure 6:
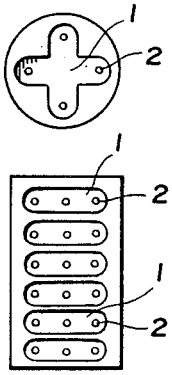
FIG. 6 shows an arrangement of nozzle holes in another embodiment of the first invention.

Nozzle holes provided in the bottom of the pitch flow section may be arranged in any desired form such as a one-line form, a checked form, a cross form, a zigzag form, a circular form and a hexagonal form as illustrated in FIG. 6.

In particular, a nozzle in which the pitch flow section has a circular inlet and nozzle holes are provided in a concentric circular form and a nozzle in which the pitch flow section has a regular polygonal inlet and nozzle holes are provided concentrically in the polygonal form are preferred in that the pitch flowing angle and the condition of the walls in the neighborhood of the nozzle holes are made completely equal and thus the same spinning conditions can be produced for each nozzle hole.

Figure 7:
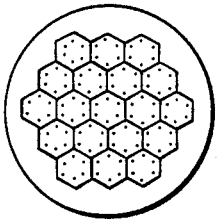
FIG. 7 is a top plan view of another embodiment of the nozzle of the first invention, which has a number of pitch flow sections.

The nozzle of the first invention comprises one or a plurality of pitch flow sections with nozzle holes as described above provided in the bottom thereof, which is of continuous structure. For example, a nozzle plate with a circular groove-shaped pitch flow section or arc groove-shaped pitch flow section as illustrated in FIG. 3 in which nozzle lines are provided in the central line, and a structure as illustrated in FIG. 7 in which a number of rectangular or hexagonal pitch flow sections are arranged in one body can be employed.

The length of the nozzle hole provided in the bottom of the pitch flow section in the nozzle of the first invention is, as described above, 0.05 to 5 mm. It is preferred that the thickness of the bottom of the pitch flow section be equal to the length of the nozzle hole.

In the nozzle of the first invention in which a number of pitch flow sections are combined together in one body, the side walls of the pitch flow section serve as rib to support the pitch inner pressure on the nozzle plate.

If desired, fillers such as metal nets and needles can be placed in the pitch flow section to prevent the formation of the laminar flow.

Various types of pitches can be melt spinned by the use of the nozzle of the first invention, including petroleum pitch, coal pitch and chemical pitch.

As the petroleum pitch, various fraction residues as obtained in the process of oil refinery, such as ordinary pressure distillation residue, vacuum distillation residue and catalytic decomposition oil residue can be used.

The coal pitch is coal tar pitch as obtained by dry distillation of coal. Any of $\alpha$-bitumen, $\beta$-bitumen, $\gamma$-bitumen and chemical tar can be used.

The chemical pitch includes residues resulting from thermal decomposition of polymeric substances such as polyolefins e.g., polyethylene and polypropylene, and polyvinyl chloride.

As the pitch to be melt spun by the use of the nozzle of the first invention, pitch in which the mesophase content is increased by application of e.g., heat treatment is preferably used.

Melt spinning by the use of the nozzle of the first invention can be carried out under the usual conditions. For example, pitch can be melt spun at a temperature of 280° to 380° C. and a spinning pressure of 1 to 20 kg/cm$^2$G.

In carbonization of the pitch fibers obtained by melt spinning by the use of the nozzle of the first invention, cracks are not found at all and there can be often obtained carbon fibers having two lamella structures oval in cross section.

In accordance with the first invention, even when there cannot be obtained the desired onion type lamella cross section, cracks are not formed at the step of carbonization or graphitization, the orientation in the axial direction is good, and physical properties such as strength and modulus of elasticity of the carbon fiber product are satisfactory.

Next the second invention will hereinafter be explained.

Figure 10:
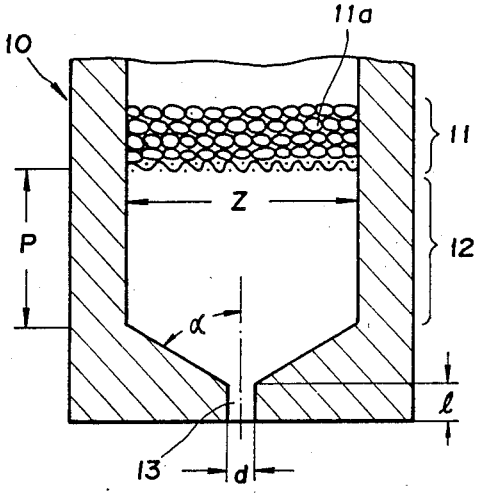
FIG. 10 is a vertical sectional view of an embodiment of the spinning nozzle to be used in the second invention.

An example of a spinning nozzle to be used in the method of the second invention is explained with reference to FIG. 10. In the spinning nozzle 10, a pitch flow turning section 11, a pitch reservoir section 12 and a nozzle hole 13 are provided in order from the upstream side.

In the pitch flow turning section 11, a material 11*a* to disturb the flow of spinning pitch is packed in a layer 1 mm to 10 cm in thickness. The material 11*a* which is used to disturb the pitch flow includes particles, powders, sintered bodies, unwoven fabrics and fabrics which are made of metals or inorganic substances. Particles are preferred, with spherical particles being most preferred. In such particles, the diameter is preferably 0.01 to 5 mm. If the particle diameter is more than 5 mm, the disturbance of the pitch flow is achieved only insufficiently. The pitch flow turning section 11 can be designed so that it can be separated from the pitch reservoir section 12.

The pitch reservoir section 12 is a part where the spinning pitch from the pitch flow turning section 11 is stored temporarily, and it is designed so that the angle $\alpha$ between the top surface adjacent to a nozzle hole 13 and the spinning direction is 45° to 100°, preferably 45° to 90°. Experiments have revealed that the angle $\alpha$ is more preferably 60° to 90° and most preferably 80° to 90° C. It is also designed so that the pitch reservoir section index G represented by the formula:

$$G = P \times \sin \alpha$$

(where P is the length of the pitch reservoir section) is within the range of 3.5 to 50. The inner diameter Z of the pitch reservoir section 12 is usually not more than 2 mm.

The spinning pitch is spun by discharging it through the nozzle hole 13 from the pitch reservoir section 12. The diameter d of the nozzle hole 13 is usually 0.005 mm to 0.5 mm and preferably 0.05 mm to 0.3 mm. The ratio of nozzle hole length (l) to nozzle hole diameter (d), i.e., l/d, is usually 0.5:1 to 20:1 and preferably 1.0:1 to 10:1.

The nozzle hole index F represented by the formula:

$$F = Z^2/d \cdot l$$

is controlled to be in the range of 20 to 5,000. Experiments have revealed that the nozzle hole index F is preferably 10 to 3,000 and more preferably 100 to 1,000.

In accordance with the method of the second invention, the spinning pitch is introduced in the spinning nozzle 10, passed through the pitch flow turning section 11 and the pitch reservoir section 12, and discharged through the nozzle hole 13 at a discharge pressure of 0.5 to 50 kg/cm$^2$, preferably 1.0 to 10 kg/cm$^2$ to obtain pitch fibers.

The spinning pitch which can be preferably used in the second invention includes coal pitch, petroleum pitch and chemical pitch. It is preferred for the spinning pitch to be optically anisotropic and to exhibit suitable fluid characteristics (viscosity and spinnability).

To prevent adhesion at the time that the pitch is not melted, the softening point of the pitch is preferred to be relatively high, although it varies with the fluid characteristics. In order to meet the above requirements, it is preferred for the pitch to have the following properties:

Number average molecular weight (Mn): 500 to 1,500, preferably 900 to 1,100.

Weight average molecular weight (Mw)/number average molecular weight (Mn): 1.1:1 to 3:1, preferably 1.5:1 to 1.7:1.

Softening point: 250° to 350° C., preferably 270° to 330° C.,

Quinoline insoluble content (QI): 5 to 60%, preferably 5 to 50%.

The present invention is described in greater detail with reference to the following examples.

EXAMPLE 1

Figure 1B:
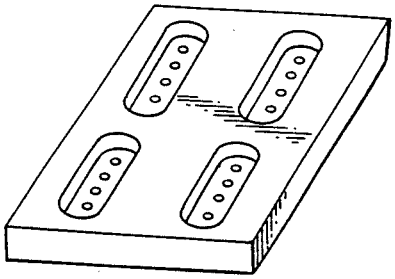

In this example, a nozzle having a rectangular form as illustrated in FIG. 1 in which ten nozzle holes were provided, a nozzle hole diameter of 0.3 mm, a nozzle length of 1.2 mm, an inlet of the pitch flow section of 3×40 mm, a depth of 11 mm, a pitch flowing angle $\alpha$ of 90°, and an average shortest wall distance of 1.5 mm was used.

The above nozzle was maintained at 338° C., by the use of which mesophase pitch having a quinoline insoluble content (QI) of 28%, a softening point of 325° C. and a number average molecular weight of 1,085 was spun at a spinning pressure of 3 kg/cm$^2$ and a spinning speed of 250 m/min to obtain pitch fibers having an average diameter of 13 $\mu$.

The pitch fibers above obtained were oxidized for 30 minutes at 200° to 360° in air and calcined for 5 minutes at 1,500° C. in a nitrogen atmosphere by the usual method.

The strength and modulus of elasticity of the carbon fibers above obtained were 320 kg/mm$^2$ and 29 ton/mm$^2$, respectively.

EXAMPLE 2

Figure 8:
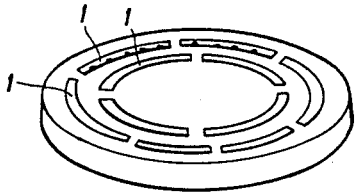
FIG. 8 is a perspective view of another embodiment of the nozzle of the first invention.

A nozzle comprising nozzle holes provided in concentric grooves as shown in FIG. 8, the total number of holes being 500, was set to a screw extruder. Mesophase pitch having a quinoline insoluble content (QI) of 23% and a softening point of 318° C. was spun by the use of the above nozzle. The vertical section of each of the concentric grooves was as shown in FIG. 2 (*b*). In this nozzle, the nozzle hole diameter was 0.2 mm, the nozzle length was 0.4 mm, the groove width was 3 mm, the depth was 12 mm, the minimum flowing angle $\alpha_{min}$ was 75°, the maximum flowing angle $\alpha_{max}$ was 90°, and the average shortest wall distance was 1.2 mm.

Molten pitch was extruded at a flow rate of 1,300 g/hr to obtain pitch fibers having an average fiber diameter of 12.8 $\mu$ and a standard deviation in unevenness of fiber diameters of 7.2%.

The pitch fibers above obtained were calcinated to produce carbon fibers having a strength of 280 kg/mm$^2$ and a modulus of elasticity of 26 ton/mm$^2$.

EXAMPLE 3

The feed used in this example was mesophase pitch having an optical anisotropic phase of 100% as obtained from a catalytic decomposition residue oil. This pitch had a softening point of 320° C., and the number average molecular weight as determined after application of Birch reduction was 1,100.

The pitch was spun by the use of a spinning nozzle having a structure as described above. Conditions for the spinning nozzle were as follows:

Thickness of the packed layer: 20 mm
Particle diameter in the packed layer: 3 mm
Z: 3 mm
P: 13 mm
d: 0.2 mm
l/d: 1:1
l: $\alpha$=90°
F: 225

Spinning was carried out at a spinning temperature of 350°C., a spinning pressure of 5 kg/cm$^2$, and a winding speed of 500 m/min to obtain pitch fibers having a diameter of 12 $\mu$.

Figure 11:
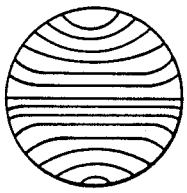
FIGS. 11 to 15 are cross-sectional views fibers obtained in Examples and Comparative Examples.

In the fibers thus obtained, cracks and spinning unevenness were not observed even after continuous spinning for 20 hours, and they had a cross section as shown in FIG. 11. The pitch fibers were heated from 200° C. to 400° C. over a period of 10 minutes to make them unmeltable. They were further calcined at 1,500° C. for 5 minutes to obtain carbon fibers. The strength and modulus of elasticity of the carbon fibers were 300 kg/mm$^2$ and 30 ton/mm$^2$, respectively.

EXAMPLE 4

The same mesophase pitch as used in Example 3 was used. The spinning nozzle used was such that the thickness of the packed layer was 10 mm, the particle diameter in the packed layer was 0.07 mm, Z=10 mm, P=20 mm, d=0.3 mm, l/d=4:1, $\alpha$=90° and F=278. Spinning was carried out at a spinning temperature of 350° C., a spinning pressure of 3 kg/cm$^2$ and a winding speed of 500 m/min to obtain pitch fibers having a diameter of 12 $\mu$ (strength: 290 kg/mm$^2$; modulus of elasticity: 28 t/mm$^2$).

Further the pitch fibers were wound at a spinning temperature of 370°C., a spinning pressure of 2 kg/cm$^2$ and a winding speed of 500 m/min to obtain pitch fibers having a diameter of 12 $\mu$ (strength: 310 kg/mm$^2$; modulus of elasticity: 30 t/mm$^2$).

Figure 12:
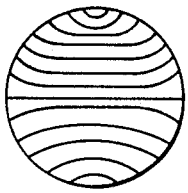
Figure 13:
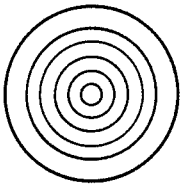

In the pitch fibers, cracks and spinning unevenness were not observed even after continuous spinning for 20 hours. The cross section of the above fibers are shown in FIGS. 12 and 13.

COMPARATIVE EXAMPLE 1

Figure 14:
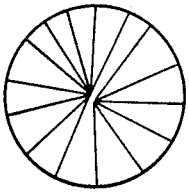

The same mesophase pitch as used in Example 3 was spun by the use of the same spinning nozzle as used in Example 3 with the exception that the packed layer was omitted, and under the same conditions as in Example 3. There were obtained pitch fibers having a strength of 250 kg/mm$^2$ and a modulus of elasticity of 20 t/mm$^2$, and with a radial cross section as shown in FIG. 14.

COMPARATIVE EXAMPLE 2

Figure 15:
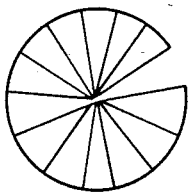

The same mesophase pitch as used in Example 3 was spun by the use of the same spinning nozzle as used in Example 3 with the exception that $\alpha$=30°, and under the same conditions as in Example 3. There were obtained pitch fibers having a cross section as shown in FIG. 15, in which cracks were partially formed.

COMPARATIVE EXAMPLE 3

The same mesophase pitch as used in Example 3 was spun by the use of a spinning nozzle in which the thickness of the packed layer was 17.8 mm, the packed layer contained sintered bodies as obtained by sintering 100 mesh nickel particles, Z=6.4 mm, d=0.5 mm, l/d=23.4:1, $\alpha$=90°, P=3 mm and F=7.0, under the same conditions as in Example 3. After 2 hours, spinning became impossible.

If the pitch melt spinning nozzle of the first invention is used, development of cracks in carbon fibers can be prevented and there can be obtained carbon fibers of high strength and high modulus of elasticity. Moreover since the structure of the nozzle is simple, there can be obtained advantages that the nozzle can be easily produced and cleaning of the melt spinning unit is easy.

In accordance with the spinning method of the second invention, pitch fibers can be produced without producing spinning unevenness and cracks.

EXAMPLE 5

In this example, a nozzle having a rectangular form as illustrated in FIG. 1 (*a*) in which 100 nozzle holes were provided, a nozzle hole diameter of 0.15 mm, a nozzle length of 0.3 mm, an inlet of the pitch flow section of 3×200 mm, a depth of 11 mm, a pitch flowing angle ($\alpha$) of 70°, and an average shortest wall distance of 1.5 mm was used. The nozzle temperature was maintained at 340° C. By the use of the above nozzle, a mesophase pitch having a QI of 30%, a softening point of 330° C. and a number average molecular weight of 1,100 was spun at a spinning pressure of 10 kg/cm$^2$ and a spinning speed of 300 m/min to obtain pitch fibers having an average diameter of 13 $\mu$.

The pitch fibers above obtained were oxidized at 200° to 400° C. for 30 minutes in air and then calcined at 1,500° C. for 5 minutes in a nitrogen atmosphere.

The strength and modulus of elasticity of the carbon fibers above obtained were 310 kg/mm$^2$ and 30 ton/mm$^2$, respectively.

EXAMPLE 6

In this example, a nozzle as illustrated in FIG. 1 (*b*) in which the total number of holes was 100 and the number of holes per the defined flowing section was 25, having a nozzle hole diameter of 0.2 mm, a nozzle length of 0.4 mm, a width of groove in the pitch flowing section of 5 mm, a depth of 15 mm, a pitch flowing angle ($\alpha$) of 90°, and an average shortest wall distance of 2.5 mm was used. A mesophase pitch having a QI of 30%, a softening point of 330° C. and a number average molecular weight of 1,100 was introduced in the nozzle by the use of a gear pump and a predetermined amount of the pitch was discharged.

The molten pitch was extruded at a flow rate of 250 g/hr to obtain pitch fibers having an average diameter of 13 and a diameter distribution that the standard deviation was 6%.

The pitch fibers thus obtained were oxidized and calcinated in the same manner as in Example 5 to obtain carbon fibers having a strength of 290 kg/mm$^2$ and a modulus of elasticity of 25 ton/mm$^2$.

EXAMPLE 7

In this example, a nozzle having the following structure was used.

Thickness of packed layer: 20 mm
Particle diameter in the packed layer: 3 mm
Z: 1.3 mm
P: 13 mm
d: 0.2
l: 0.4
l/d: 2
$\alpha$: 70°
F: 21

The same pitch as used in Example 3 was spun by the use of the above nozzle. Spinning was carried out at a spinning temperature of 350°C., a spinning pressure of 5 kg/cm$^2$, and a winding speed of 500 m/min to obtain pitch fibers having a diameter of 12 $\mu$.

In the fibers thus obtained, cracks and spinning unevenness were not observed even after continuous spinning for 20 hours. The pitch fibers were heated to 200° to 400° C. over a time of 10 minutes to make them unmeltable. They were further calcined at 1,500° C. for 5 minutes to obtain carbon fibers. The strength and modulus of elasticity of the carbon fibers were 320 kg/mm$^2$ and 32 ton/mm$^2$, respectively.

EXAMPLE 8

In this example, a nozzle having the following structure was used.

Thickness of packed layer: 25 mm
Particle diameter in the packed layer: 3 mm
Z: 4 mm
P: 15
d: 0.2 mm
l: 0.7 mm
l/d: 3.5
$\alpha$: 90°
F: 114

The same pitch as used in Example 3 was spun by the use of the above nozzle under the same conditions as in Example 7.

In the fibers thus obtained, cracks and spinning unevenness were not observed even after continuous spinning for a time of 20 hours. The pitch fibers were oxidized and calcined in the same manner as in Example 7 to obtain carbon fibers having a strength of 280 kg/mm$^2$ and a modulus of elasticity of 28 ton/mm$^2$.

What is claimed is:

1. A nozzle for melt-spinning of pitch to produce pitch fibers, and which produces no substantial spinning unevenness, comprising:

nozzle means for receiving the pitch, and including a pitch flow turning section, a pitch reservoir section having a top surface and in which an angle $\alpha$ between said top surface and a spinning direction is 45° to 100°, and at least two nozzle holes having a nozzle hole index F ($=Z^2/d \cdot l$) of not less than 10 and not more than 5,000 where Z is the inner diameter of the pitch reservoir section, l is the nozzle hole length, and d is the nozzle hole diameter;

said nozzle means being arranged such that the pitch is passed first through said pitch flow turning section, secondly through said pitch reservoir section, and thereafter through said at least two nozzle holes;

said pitch reservoir section defining a storing space between said pitch flow turning section and said at least two nozzle holes; and a pitch flow disturbing material in said pitch flow turning section and through which said pitch is passable for disturbing a flow of spinning pitch passing therethrough.

2. The nozzle of claim 1, wherein the length of each nozzle hole is 0.05 to 5 mm.

3. The nozzle of claim 2, wherein the ratio of nozzle hole length (l) to nozzle hole diameter (d), (l/d), is 0.5:1 to 10:1.

4. The nozzle of claim 1, wherein the ratio of nozzle hole length (l) to nozzle hole diameter (d), (l/d), is 0.5:1 to 10:1.

5. The nozzle of claim 1, wherein said pitch flow disturbing material is comprised of metal particles having a melting point higher than the operating temperature of the melt spinning nozzle.

6. The nozzle of claim 1, wherein said pitch flow disturbing material is comprised of a powder made of a material different from the pitch material and having a melting point higher than the operating temperature of the melt spinning nozzle.

7. The nozzle of claim 1, wherein said pitch flow disturbing material comprises a sintered body made of a material different from the pitch material and having a melting point higher than the operating temperature of the melt spinning nozzle.

8. The nozzle of claim 1, wherein said pitch flow disturbing material comprises an unwoven fabric material made of a material different from the pitch material and having a melting point higher than the operating temperature of the melt spinning nozzle.

9. The nozzle of claim 1, wherein said pitch flow disturbing material comprises a fabric material made of a material different from the pitch material and having a melting point higher than the operating temperature of the melt spinning nozzle.

10. The nozzle of claim 1, wherein said metal particles have a diameter of from 0.01 to 5 mm.

11. The nozzle of claim 1, wherein said angle $\alpha$ between said top surface of said pitch reservoir section and said spinning direction is 45° to 90°.

12. The nozzle of claim 1, wherein said angle $\alpha$ between said top surface of said pitch reservoir section and said spinning direction is 80° to 90°.

13. The nozzle of claim 1, wherein said pitch flow disturbing material is comprised of particles of inorganic material having a melting point higher than the operating temperature of the melt spinning nozzle.

14. The nozzle of claim 1, wherein said particles of inorganic material have a diameter of from 0.01 to 5 mm.

15. The nozzle of claim 1, wherein said pitch flow disturbing material turning in said pitch flow section is in a layer having a thickness of between 1 mm and 10 cm.

* * * * *

UNITED STATES PATENT AND TRADEMARK OFFICE

CERTIFICATE OF CORRECTION

PATENT NO. : 4,887,957

DATED : December 19, 1989

INVENTOR(S) : OHTA et al

It is certified that error appears in the above-identified patent and that said Letters Patent is hereby corrected as shown below:

Column 12, line 15 (claim 14):

"of claim 1" should read --of claim 13--.

Signed and Sealed this

Twenty-seventh Day of August, 1991

*Attest:*

HARRY F. MANBECK, JR.

*Attesting Officer*

*Commissioner of Patents and Trademarks*